United States Patent [19]

Hinterholzer

[11] Patent Number: 4,871,279

[45] Date of Patent: Oct. 3, 1989

[54] SLALOM POST

[76] Inventor: Hans Hinterholzer, Post Box 118, N-1545, Hvitsten, Norway

[21] Appl. No.: 228,275

[22] Filed: Aug. 4, 1988

[30] Foreign Application Priority Data

Aug. 10, 1987 [AT] Austria ..... 2008/87
Feb. 3, 1988 [DE] Fed. Rep. of Germany ..... 3803150

[51] Int. Cl.[4] ..... E01F 9/00
[52] U.S. Cl. ..... 404/10; 52/165
[58] Field of Search ..... 404/9–11; 52/159, 162, 165; 40/607; 248/156; 116/63 P, 173; 272/3, 56.5 SS

[56] References Cited

U.S. PATENT DOCUMENTS 766,100 7/1904 Carson ..... 52/159
4,270,873 6/1981 Laehy et al. ..... 404/10
4,588,324 5/1986 Goellner ..... 404/10
4,702,639 10/1987 Hinterholzer ..... 404/10

FOREIGN PATENT DOCUMENTS 173969 3/1986 European Pat. Off. ..... 404/10

*Primary Examiner*—Jerome W. Massie, IV
*Assistant Examiner*—Gay A. Spahn
*Attorney, Agent, or Firm*—Hugh Adam Kirk

[57] ABSTRACT

A slalom post (1) is described comprising at least one eccentrically pivoted disc-like anchor element (5, 8) normally positioned substantially within the cross-sectional area of the lower end of the post. By simply twisting the slalom post (1) around its vertical longitudinal axis (4), the anchoring element (5, 8) is brought from its normal ineffective position into its effective anchoring position by rotation around a vertical axis offset and parallel to the vertical longitudinal axis of the slalom post. If desired, a roughened peripheral edge of the disc may be provided for engagement with the snow or ice into which the lower end of the post is placed so that the rotation of the post will rotate the disc-like anchoring element relative thereto to move it into its effective anchoring position. A stop or guide means may be attached to the post or the extension thereof containing the anchoring element in order to limit the orthogonal projection of the anchoring means in both its ineffective and most effective positions. Furthermore, sleeves may be provided over the lower end of the post for indicating whether the post is to be rotated clockwise or counterclockwise and for lining the hole into which the end of the slalom post is to be inserted.

11 Claims, 4 Drawing Sheets

Fig.1
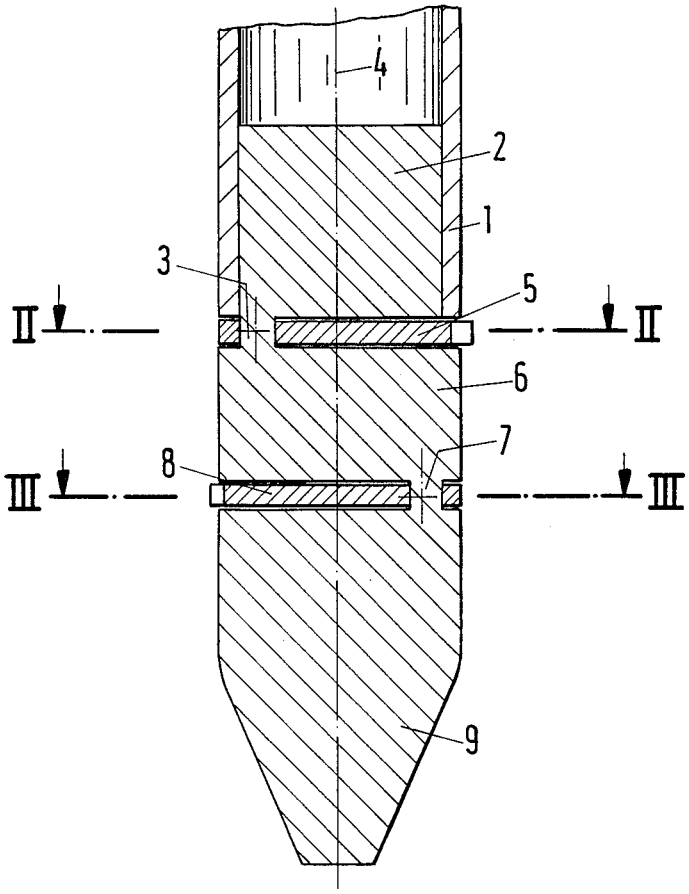
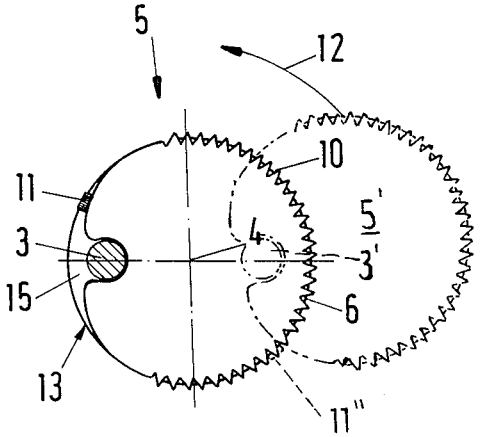
Fig.2
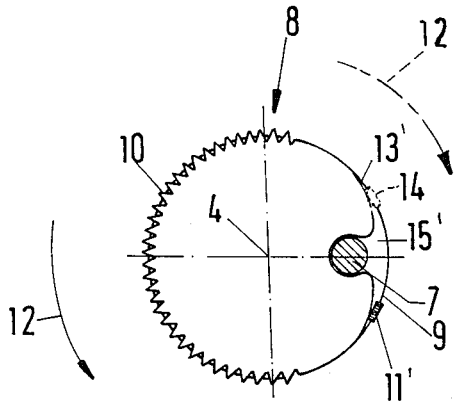
Fig.3

SLALOM POST

BACKGROUND OF THE INVENTION

This invention is an improvement in applicant's prior U.S. Pat. No. 4,702,639 issued Oct. 27, 1987. In this patent, the disc-like anchoring element is rigidly connected to the lower end of the slalom post and projects radially from the normal cylindrical surface of the post. This radially projected position of this anchoring element is protected in its ineffective position by a wedge or radial extension of the post mounted on a sleeve around the post, which wedge prevents rotation of the sleeve with rotation of the post. Thus the twisting of the post moves the disc anchoring element from its ineffective position protected by the wedge to an effective position angularly spaced from its protected position and horizontally into the medium of snow, snow-ice, or ice surrounding the lower end of the slalom post. The wedge projection disclosed in this patent gives an irregular and thickened cross-sectional contour to the lower end of the slalom post, which not only complicates its construction, but also often is an undesirable feature.

SUMMARY OF THE INVENTION

Generally speaking, this invention comprises an extension for the lower end of a tubular slalom post, which extension is provided with one or more discs conforming substantially to the cross-sectional area of the extension and post, which discs are moved from an ineffective position inside the cross-sectional area of the post to an effective anchoring position outside the cylindrical surface of the post to anchor the post into the ground such as snow and/or ice. These discs are moved horizontally inside and outside of the post contour by twisting the post about its longitudinal vertical axis. This movement of the disc-like anchoring elements is effected by pivoting these disc elements about separate parallel axes offset radially from the longitudinal vertical axis of the post and its lower extension in which these discs are mounted. Because the slalom post and its lower end extension have substantially the same circular profile, it is easily slipped into the snow hole, and because the disc-like anchoring elements are loosely pivoted on their offset axes eccentric to the longitudinal vertical axis of the post, rotation or oscillation of the slalom post is easy and the peripheral edges of the anchoring discs readily engage the surface of the snow hole for relative motion to the twisting of the post. This relative motion forces the eccentrically pivoted disc radially outwardly into the snow for anchoring the lower end of the post therein. Rotation of the post in the opposite direction causes the anchoring element to be brought back again into the profile of the slalom post so that the anchoring element is in its non-effective or ineffective position and the post can easily then be withdrawn from the snow hole.

If desired, a plurality of disc-like anchoring elements may be axially spaced along the lower end extension of the post, with their axes equally angularly spaced around the central axis of the post so that the same twisting motion will cause the disc to project in different directions into adjacent radial positions for improving the anchoring of the post into its snow hole. These disc-like anchoring elements may be pinned to their offset axes or the discs may be notched for easy snapping onto the axles on these offset axes for easy assembly and/or replacement. In order to improve the engagement of the disc-like anchoring elements into the snow, their peripheral edges may be roughened or serrated, and/or preferably their peripheral edges may project very slightly at least, in at least one angular position, beyond the outside cylindrical surface of the lower end of the post and/or its extension.

In order to insure that the twisting of the post will not cause the disc-like anchoring elements to be retracted again into the profile of the post, there are provided guides or stops anchored to the extension which is anchored to the end of the post. These guides bridge the gap into which the anchoring elements are retracted, and are located adjacent the outer cylindrical surface of the post or its extension and at an acute angle on one side of the offset or eccentric axis for each anchoring element. These stops engage the periphery of the disc-like anchoring elements so that their rotation about their axes is limited in both directions, namely in the anchoring element's ineffective position substantially within the cross-sectional profile of the post and in its most effective position wherein it is projected as far as possible radially outwardly from the post in its best anchoring position.

Tests have shown that race runners that touch the slalom posts during races can twist them around their axes slightly and thus cause them to release their anchoring elements. This is prevented by providing anchoring elements that are projected when the post is rotated in either a clockwise or counterclockwise direction, or both. The difference in rotation is determined by which side of the offset axis the stop is located and special markings may be provided on the post for indicating whether it is a clockwise or counterclockwise post. Furthermore, a sleeve may be provided on the post which may be limited in its angular relative rotation with the axis of the post to position the stop or guide means from one side to the other of the offset axis relative to the central axis of the post per se. Thus, if a post is to be passed on one side by the skier, if it is touched on that side, a post is selected which will not rotate to cause the anchoring elements to retract, but on the contrary to insure their extension.

Instead of moving the stop or guide, the anchoring disc may be provided with a slot radially extending from its offset axis into which slot a guide from a sleeve around the end of the post may fit. This sleeve may have a roughened outer surface for anchoring it in the snow so that rotation of the post will be relative thereto and cause the slotted disc to project orthogonally into the snow, regardless of which direction the post is rotated from the ineffective postion for the anchoring element within the circumferential profile of the cross-section of the post. In this embodiment there also may be provided marking means for indicating when the sleeve and post are in the position in which the anchoring element is in its ineffective position for easy insertion of the post into its snow hole.

If desired, depending upon the medium in which the posts are to be located, there may be provided sleeves for lining the snow holes which are separate from the post and remain in the snow and ice whether or not a slalom post is inserted therein or not. Because of the uniform outer peripheral profile of the slalom post of this invention, these sleeves may be used without special configuration as would be required for the slalom post described in the applicant's above mentioned U.S. Pat. No. 4,702,639. Furthermore, special tools may be provided for making the snow holes for the sleeves and/or slalom posts, and even tools for undercutting the hole for receiving the disc-like anchoring elements of this invention, particularly if the holes are in ice.

OBJECTS AND ADVANTAGES

It is an object of this invention to produce a simple, efficient, effective, easy-to-construct, easy-to-install, and easy-to-operate slalom post with extendible and retractable anchoring means at its lower end.

Another object is to produce such a slalom post in which the anchoring means when in its ineffective position is substantially completely retractable within the cylindrical cross-sectional area of the lower end of the slalom post, whereby it may be easily inserted and removed from snow holes provided therefor.

Still another object is to provide slalom posts which can be twisted in either or both directions for operation and markings to indicate for which direction it is set up.

BRIEF DESCRIPTION OF THE VIEWS

The above mentioned features, objects and advantages, and the manner of attaining them are described more specifically below by reference to embodiments of this invention shown in the accompanying drawings, wherein:

FIG. 1 is a vertical sectional view through the lower end of a slalom post showing a preferred embodiment of the invention;

FIG. 2 is a cross-section taken in the direction of the arrows along line II—II of FIG. 1 showing in full lines an anchoring element in its ineffective or retracted position and in dotted lines the same element in its effective or extended anchoring position;

FIG. 3 is a cross-section taken in the direction of the arrows along line III—III of FIG. 1 showing the other of the two similar anchoring elements in its retracted or ineffective position and in dotted lines the location of a guide means for limiting the oscillations of the anchoring element when the slalom post is rotated in the opposite direction;

DETAILED DESCRIPTION OF PREFERRED EMBODIMENTS

Figure 4:
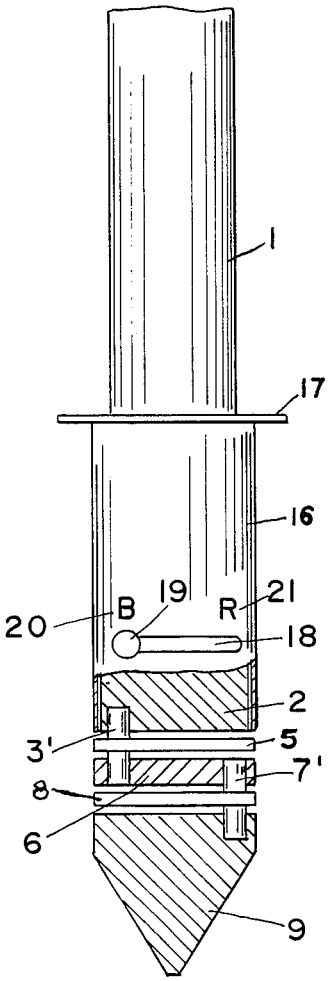
FIG. 4 is a view similar to FIG. 1 showing another means of constructing the extension with separate eccentric axles for the anchoring elements and with a surrounding sleeve for indicating whether the post is to be rotated clockwise or counterclockwise for its operation, which sleeve has a depth-limiting upper flange.

Referring first to FIG. 1 there is shown in vertical section the lower end of a tubular slalom post 1 which may be made of a lightweight and/or flexible material, such as plastic tubing, and also may have a built-in joint like that disclosed and described in the above mentioned U.S. Pat. No. 4,702,639. Fitted into the open end of the tube 1 is an extension member comprising parts 2, 6, and 9 connected integrally together by the offset axes of the pivotal shaft portions 3 and 7, and also fixedly connected to the lower end of the post 1. If desired, these shaft portions may be separate axles 3' and 7' from the sections 2, 6, and 9 and anchored thereto by pins (not shown) as illustraed in FIG. 4. These shafts or axles 3, 3' and 7, 7' are on axes offset and parallel to the vertical longitudinal axis 4 of the post 1 and its extension, and in this specific instance the two separate offset shafts 3 and 7 or 3' and 7' are offset on opposite sides of the axis 4 as also shown in FIGS. 2 and 3.

Pivoted to these offset axles 3 and 7 or 3' and 7' are the disc-like anchoring elements 5 and 8, respectively, which in this embodiment are shown to have snap notches 15 for easy insertion of these elements onto these axles 3 and 7 for easy assembly and/or replacement. If desired, and preferably, the peripheries of these anchoring elements 5 and 8 are provided at least a small part of their circumference with a roughened edge and even teeth 10, for better engagement with the snow in the snow hole to insure their relative movement when the post is rotated. Thus these anchoring elements will be moved outwardly into their effective anchoring position, such as shown for its element 5 in its dotted-like position 5' shown in FIG. 2 when the post 1 is rotated in the direction of the arrow 12 about its longitudinal vertical axis 4.

In order to limit the movement of the anchoring elements 5 and 8, there are provided connected to the post and/or its extension stops or guide means 11 and 11', against which the peripheral edge of the anchoring elements 5 and 8 are engaged when in their inoperative position as shown in full lines in FIGS. 2 and 3. Also when the post is rotated so that the stop 11 is in the position 11'', the position 13 on the anchoring element 5 will engage the stop 11'' when the anchoring element is in its fully extended dotted-line position 5' shown in FIG. 2, and thus preventing the anchoring element 5 from being rotated back into its non-effective position. Similarly the guide or stop 11' operates for the other and lower disc-like anchoring element 8 as shown in FIG. 3, but its anchoring element 8 projects outwardly from the opposite side of the post 1 from that of 5' in FIG. 2.

In the event the slalom post is to be rotated in the opposite direction as shown by the dotted arrow 12' in FIG. 3, there is provided a stop 14 in dotted lines on the opposite side of the axis 7 from that of the stop 11' to insure proper operation of the anchoring element 8 and to prevent its operation if the post 1 is rotated around its axis 4 in the direction of the arrow 12 instead of the direction of arrow 12'.

Referring now to FIG. 4 showing separate sections 2, 6, and 9 connected by separate axles 3' and 7' as mentioned above, this particular extension is provided with a sleeve 16 having an upper radially outwardly extending flange 17. This sleeve 16 is attached to the lower end of the post 1 and limited in its relative rotational movement by the pin 19 in the partial circumferential slot 18. Opposite ends of this slot may be indicated by a blue marking 20 at one end and a red marking 21 at the other for correspondingly indicating the location of the stop means 11 or 14 (see FIGS. 2 and 3) which indicates whether this particular slalom pole and its extension are to be operated for clockwise or counterclockwise rotation, respectively. The sleeve 16 is solely for indicating whether the slalom post is to be rotated clockwise or counterclockwise and once this is determined, the screw 19 is tightened to fasten the sleeve to the pole 1 so that this sleeve 16 rotates with the pole 1 and not relative thereto.

Figure 5:
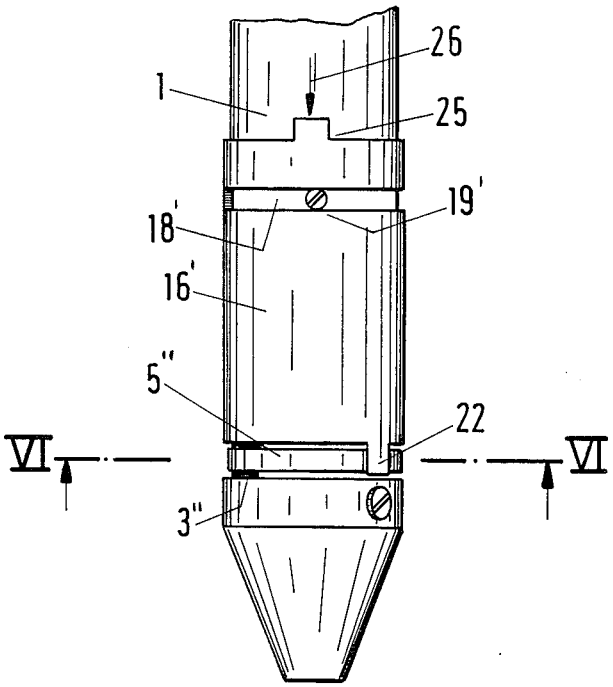
FIG. 5 is a side view of another embodiment of the lower end of a slalom post showing a different type of guide in a sleeve engaged in a snow hole for limiting the rotation of the post relative thereto and for moving the disc-like anchoring element from its neutral ineffective position into an effective position by either a clockwise or a counterclockwise rotation of the post.
Figure 6:
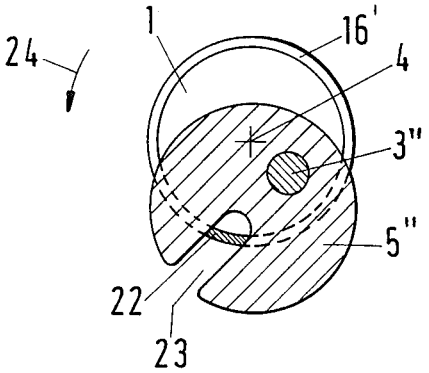
FIG. 6 is a sectional view taken in the direction of the arrows along line VI—VI of FIG. 5 showing the radial slot in the anchoring element and the guide of the sleeve in said slot.

Referring now to the embodiment disclosed in FIGS. 5 and 6, herein the lower end of the post 1 is provided with a different type of a sleeve 16' which also has a peripheral slot 18' into which a screw 19' is placed for limiting the rotational movement of the sleeve relative to the end of the slalom post 1. The outside of this sleeve 16' may be roughened so that it will engage the inner surface of the snow hole and remain stationary as the slalom post is oscillated about its axis 4. This sleeve 16' however has a guide extension 22 which fits into a radial slot from the pivot 3'' of the disc-like anchoring element 5'' so that relative rotation of the post about the axis 4 will cause the anchoring element 5'' to be moved out from its ineffective position within the circumferential cylindrical contour of the post as shown in FIG. 5 into a position as shown in FIG. 6. The positive movement of the disc 5'' by the extension 22 enables rotation of the post 1 in either direction from its neutral ineffective position so that the anchoring element 5'' can be moved outwardly on either side of the post 1. Thus, regardless of whether the post 1 is rotated about its axis 4 clockwise or counterclockwise from its neutral position, the anchoring element 5'' will be extended into an effective or operative position. For insertion of this embodiment into the snow hole, the projection 25 on the sleeve 16' must be aligned with the marking 26 to insure that the anchoring element 5'' is in the position shown in FIG. 5 and not extended on either side thereof, such as rotation in the direction of the arrow 24 in FIG. 6.

Figure 7:
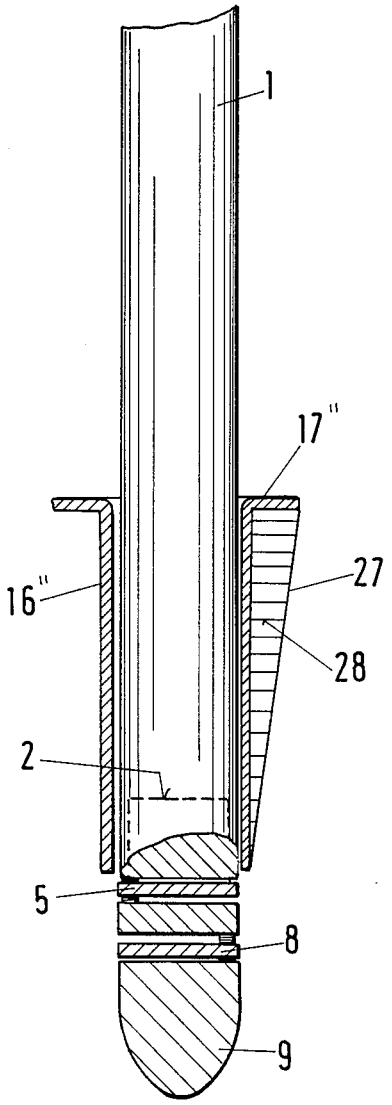
FIG. 7 is a vertical sectional view of a separate guide sleeve for a snow hole with the lower end of a slalom post, as shown in FIG. 1, inserted in said guide sleeve.

Referring to FIG. 7, there is shown a pole and its extension device similar to that shown in FIG. 1, but surrounding the post is a separate sleeve 16'' which is not connected to the pole at all, but is merely used as a liner for the snow hole. This sleeve is shown to have a circumferential flange 17'' for limiting the depth in which the sleeve 16'' is inserted into the hole. To insure the permanency and the non-rotation of the sleeve 16'', it is provided with a fin or wedge portion 27 which may be serrated or grooved at 28 to further insure its locking position into the snow hole. This sleeve 16'' is solely for guiding and positioning the slalom post 1.

These separate sleeves 16'' are primarily used for insertion into snow or ice in which a tool is needed for making the snow hole. This tool also may include a means for undercutting the lower end of the hole for the extension of the anchoring elements 5, 5', 5'' and 8. The sleeve 16'' thus both marks the position where the slalom post is to be located and enables its easy installation. The depth of the hole is greater than the depth of the sleeve 16'' so that the anchoring devices can be extended outwardly below the lower edge of the sleeve 16'' as shown in FIG. 7 with the post installed therein.

While there is described above the principles of this invention in connection with specific apparatus, it is to be clearly understood that this description is made only by way of example and not as a limitation to the scope of this invention.

What is claimed is:

1. A slalom post having a central longitudinal axis and a cylindrical outer surface, and having at its lower end an anchoring means, said anchoring means comprising: a sleeve around said post, a disc-like anchoring element below said sleeve having an area substantially equivalent to the circular cross-sectional area of the cylindrical surface of said post, a pivot for said element on an axis offset and parallel to the central vertical axis of said post, and a guide means on said sleeve engaging said anchoring element for limiting the relative oscillations of said anchoring element to the oscillations of said post about its central vertical axis, whereby oscillation of said post about its central vertical axis causes said anchoring element to move about its offset axis from an ineffective position substantially within the cross-sectional area of said post to an effective anchoring position projecting radially outwardly from the cylindrical surface of said post, and vice versa.

2. A slalom post having a central longitudinal axis and a cylindrical outer surface, and having at its lower end an anchoring means, said anchoring means comprising: a disc-like anchoring element having an area substantially equivalent to the crosssectional area of the cylindrical surface of said post, a pivot for said element on an axis offset and parallel to the central vertical axis of said post, and a guide means for limiting the relative oscillations of said anchoring element to the oscillations of said post about its central vertical axis, said guide means comprising a stop connected to said post and contactable by the periphery of said anchoring element, whereby oscillation of said post about its central vertical axis causes said anchoring element to move about its offset axis from an ineffective position substantially within the cross-sectional area of said post to an effective anchoring position projecting radially outwardly from the cylindrical surface of said post, and vice versa.

3. A slalom post according to claim 2 wherein said anchoring means is fixedly attached to said lower end of said post.

4. A slalom post according to claim 2 wherein said anchoring element is provided with a snap notch for engaging its pivoted axis.

5. A slalom post according to claim 4 wherein said pivots for said plurality of anchoring elements are equally angularly spaced around said central vertical axis of said post and said anchoring means.

6. A slalom post according to claim 2 including a sleeve around said post for limiting the vertical position of said post.

7. A slalom post according to claim 2 having a plurality of said anchoring elements axially spaced along said anchoring means.

8. A slalom post having a central longitudinal axis and a cylindrical outer surface, and having at its lower end an anchoring means comprising: a disc-like anchoring element having an area substantially equivalent to the cross-sectional area of the cylindrical surface of said post, a pivot for said element on an axis offset and parallel to the central vertical axis of said post, and a guide means for limiting the relative oscillations of said anchoring element to the oscillations of said post about its central vertical axis, said anchoring element having a slot extending radially from its pivotal axis and said guide means moves in said slot, whereby oscillation of said post about its central vertical axis causes said anchoring element to move about its offset axis from an ineffective position substantially within the cross-sectional area of said post to an effective anchoring position projecting radially outwardly from the cylindrical surface of said post, and vice versa.

9. A slalom post according to claim 8 wherein said anchoring means includes a sleeve for limiting the oscillations of said slalom post, and said guide means is attached to said sleeve.

10. A slalom post according to claim 9 wherein said sleeve has a radially extending flange.

11. A slalom post according to claim 8 wherein said post includes means for indicating clockwise and counterclockwise rotation of said post for operation of said anchoring element.

* * * * *